United States Patent [19]

Kitamura et al.

[11] 4,176,638

[45] Dec. 4, 1979

[54] EGR CONTROL SYSTEM FOR ENGINE EQUIPPED WITH FUEL INJECTION SYSTEM

[75] Inventors: Hidetoshi Kitamura; Jun Sato, both of Tokyo, Japan

[73] Assignee: Nissan Motor Company, Limited, Yokohama, Japan

[21] Appl. No.: 897,516

[22] Filed: Apr. 18, 1978

[30] Foreign Application Priority Data

Jun. 27, 1977 [JP] Japan ..... 52/84992[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,931,813 | 1/1976 | Horie et al. | 123/119 A |
| 4,031,871 | 6/1977 | Hamanishi | 123/119 A |
| 4,041,917 | 8/1977 | Suzuki | 123/119 A |
| 4,056,084 | 11/1977 | Baumgartner | 123/119 A |
| 4,069,797 | 1/1978 | Nohira et al. | 123/119 A |
| 4,092,960 | 6/1978 | Nohira et al. | 123/119 A |
| 4,094,287 | 6/1978 | Nohira | 123/119 A |
| 4,112,894 | 9/1978 | Nohira | 123/119 A |
| 4,128,089 | 12/1978 | Takimoto | 123/119 A |
| 4,137,874 | 2/1979 | Otsubo et al. | 123/119 A |

*Primary Examiner*—Wendell E. Burns

[57] ABSTRACT

An EGR control system for a motor vehicle engine equipped with an electronically controlled fuel injection system is so arranged and constructed that EGR rate is controlled in accordance with the mutual action of pressure in an EGR passageway and venturi vacuum generated at a venturi in an intake passageway under urban area driving condition, whereas in accordance with the mutual action between the pressure in the EGR passageway and pressure in the intake passageway immediately downstream of an airflow meter forming part of the electronically controlled fuel injection system under suburban area driving condition.

9 Claims, 3 Drawing Figures

EGR CONTROL SYSTEM FOR ENGINE EQUIPPED WITH FUEL INJECTION SYSTEM

BACKGROUND OF THE INVENTION

This invention relates to an EGR (Exhaust Gas Recirculation) control system for controllably recirculating a portion of the exhaust gases passing through the exhaust passageway of an internal combustion engine back to the combustion chamber of the same, and more particularly to an improvement in the EGR control system of the engine equipped with an electronically controlled fuel injection system.

It is well known in the art that a part of the exhaust gases of an internal combustion engine is recirculated back to the combustion chamber of the engine in order to suppress the maximum temperature of the combustion taken place in the combustion chamber to reduce the emission level of nitrogen oxides (NOx) which are generated during the combustion in the combustion chamber. By virtue of this exhaust gas recirculation, the NOx emission level has thus effectively been lowered. However, the recirculated exhaust gas considerably affects the combustion in the combustion chamber and stability of the engine and therefore its amount is desired to be strictly controlled in response to engine operating conditions.

In this regard, the following EGR control system has been proposed: An EGR control valve is closeably disposed in an EGR passageway connecting an intake passageway and an exhaust passageway of an internal combustion engine. The EGR control valve is operated to control the amount of the exhaust gas recirculated back to the combustion chamber of the engine, which is accomplished by varying the exhaust gas pressure in the EGR passageway upstream of the EGR control valve in accordance with the variations of a venturi vacuum in the intake passageway. By this EGR control system, the recirculated gas flow is prevented from being affected by the variation of exhaust gas pressure in the EGR passageway. As a result, the recirculated exhaust gas flow can be controlled only in accordance with the venturi vacuum which is highly reliable as a function of the flow amount of the intake air conducted through the intake passageway into the combustion chamber. This EGR control system makes it possible to effectively decrease NOx emission level without causing the degradation of the driveability of motor vehicles.

It has now been carried out, with the above-mentioned EGR control system, to effectively lower the volume rate of the recirculated exhaust gas relative to the intake air inducted into the combustion chamber (this rate is referred to as "EGR rate") under a suburban area driving condition of the motor vehicle on which the EGR control system is mounted. Because, under such a condition, a relatively stable engine operation is maintained decreasing NOx generation in the combustion chamber, and less EGR seems to be suitable from view points of improving driveability and fuel economy of the vehicle during high speed cruising.

However, even by such an EGR control manner, difficulties have been encountered in which the combustion condition in the engine combustion chamber is abruptly changed to a great extent at a moment that the vehicle driving condition is changed from urban area driving condition into the suburban area driving condition and therefore the driveability of the vehicle is considerably degraded. Additionally, nearly no EGR is undesirable from a point of view of NOx emission control.

SUMMARY OF THE INVENTION

It is the main object of the present invention to provide an improved EGR control system for motor vehicle internal combustion engine, by which EGR rate is effectively decreased under suburban area driving condition of the vehicle, maintaining a sufficient emission control and without causing an excessive degradation of the driveability of the vehicle.

Another object of the present invention is to provided an improved EGR control system for a motor vehicle internal combustion engine, by which an excessive degradation of the driveability of the vehicle is not caused even at the moment that urban area driving condition is changed into the suburban area driving condition, maintaining a sufficient degree of emission control.

A further object of the present invention is to provide an improved EGR control system for a motor vehicle internal combustion engine equipped with an electronically controlled fuel injection system, by which EGR rate is so controlled that an excessive decrease in EGR rate is not abruptly occurred even at the moment that the urban area driving condition is changed into the suburban area driving condition.

A still further object of the present invention is to provide an improved EGR control system for a motor vehicle internal combustion engine equipped with an electronically controlled fuel injection system, by which EGR rate is controlled in accordance with the mutual action between venturi vacuum generated at a venturi in an intake passageway and pressure in an EGR passageway providing communication between the intake passageway and an exhaust gas passageway under urban area driving condition, whereas in accordance with the mutual action of the pressure in the EGR passageway and pressure in the intake passageway between the venturi and an airflow meter forming part of the fuel injection system under suburban area driving condition.

Other objects, features and advantages of improved EGR control system according to the present invention will be apparent from the following description taken in conjunction with the accompanying drawings.

DESCRIPTION OF THE PREFERRED EMBODIMENTS

Figure 1:
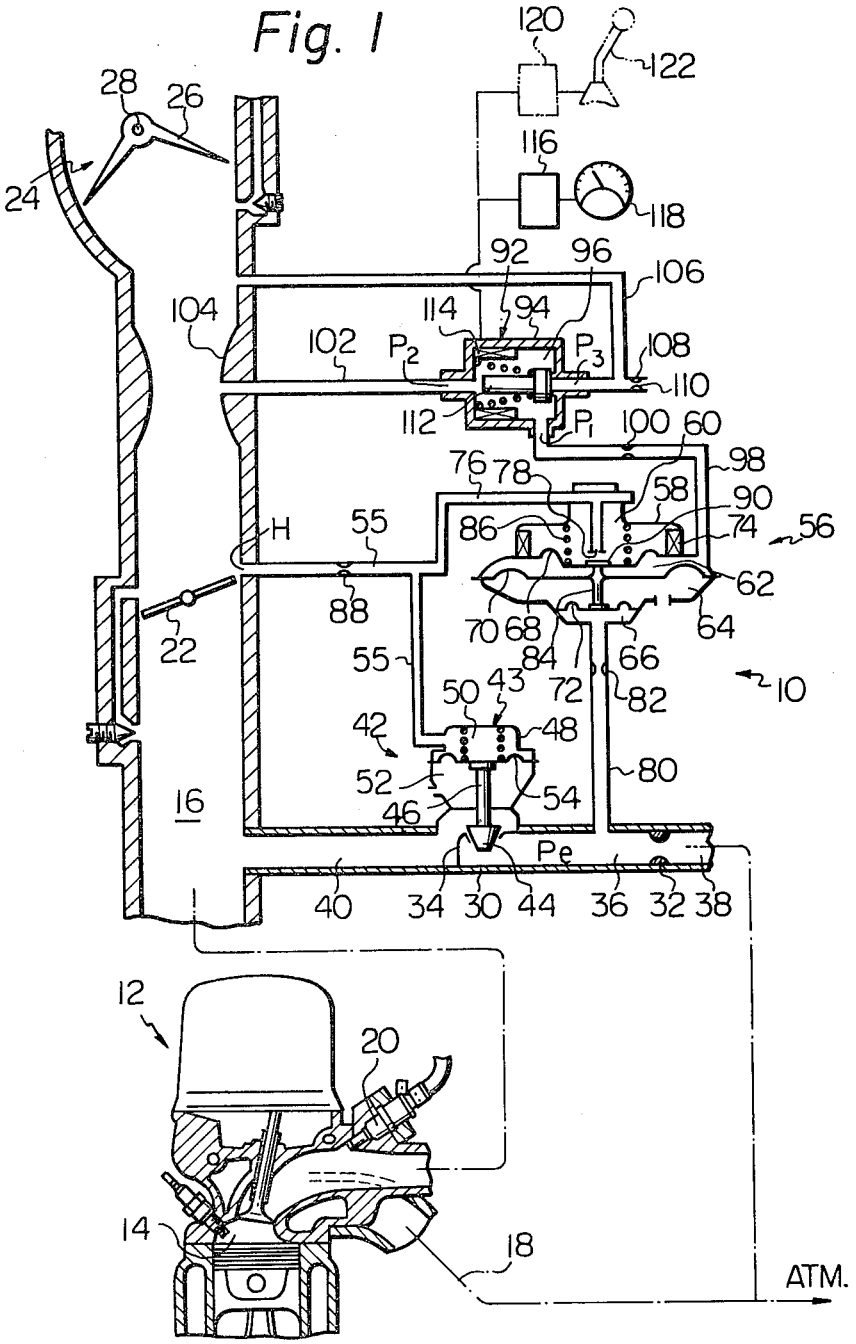
FIG. 1 is a schematic illustration of a preferred embodiment of an EGR control system in accordance with the present invention, in combination with a motor vehicle internal combustion engine equipped with electronically controlled fuel injection system.

Referring now to FIG. 1 of the drawings, a preferred embodiment of an exhaust gas recirculation (EGR) control system 10 according to the present invention is shown as combined with an internal combustion engine of a motor vehicle or an automobile. The engine includes an engine proper 12 in which a combustion chamber 14 or combustion chambers are, as usual, formed. The combustion chamber 14 is communicable with the atmosphere through an intake passageway 16 forming part of the intake system of the engine. The combustion chamber 14 is further communicable with the atmosphere through an exhaust gas passageway 18 forming part of the exhaust system of the engine. Reference numeral 20 denotes a fuel injector forming part of an electronically controlled fuel injection system (no numeral) which is arranged to supply the combustion chamber with a suitable amount of fuel in accordance with various engine operating parameters. This system is known in the art and accordingly its detail explanation is omitted for the purpose of simplicity of description.

A throttle valve 22 is rotatably disposed in the intake passageway 16 upstream of the fuel injector 20 to control the amount of intake air inducted into the combustion chamber. Disposed upstream of the throttle valve 22 is an airflow meter 24 or sensor for detecting the flow amount of the intake air inducted through the intake passageway 16. As shown, the airflow meter 24 is composed of a movable measuring plate 26 which is pivotally mounted on a shaft 28. The measuring plate 26 is arranged to be opened by the air stream against the force of a spring (not shown). The position of the measuring plate is sensed, for example, by means of a potentiometer (not shown).

The EGR control system 10 is composed of an EGR passageway 30 providing communication between the exhaust gas passageway 18 and the intake passageway 16 downstream of the throttle valve 22 for recirculating or conducting engine exhaust gas into the intake passageway 16. The EGR passageway 30 is formed therein with an orifice 32 and a partition member 34 which divides the EGR passageway 30 into an upstream portion 36, 38 and downstream portion 40. In the upstream portion, a chamber 36 is defined between the orifice 32 and the partition member 34. The orifice 32 provides communication between a part 38 of the upstream portion and the chamber 36 and forms a restriction of the EGR passageway 30 which controls the flow of recirculated engine exhaust gas. The orifice 32 may not be used if the EGR passageway 30 is provided with any restriction for the flow of exhaust gases which restriction has the similar function to the orifice 32. The partition member 34 forming a valve seat is formed therethrough with an aperture or passage (no numeral) which provides communication between the chamber 36 and the downstream portion 40.

An EGR control valve assembly 42 is disposed such that its valve head 44 in the EGR passageway 30 is movable relative to the partition member 34. The valve head 44 is secured to a valve stem 46 extending therefrom externally of the EGR passageway 30. The EGR control valve assembly 42 includes a diaphragm unit 43 for operating the EGR control valve 42. The diaphragm unit 34 is composed of a housing 48 having first and second fluid chambers 50 and 52, and a flexible diaphragm 54 separating the fluid chambers 50 and 52 from each other. The fluid chamber 52 is communicated through a hole (no numeral) with the atmosphere. A spring (no numeral) is provided to normally urge the diaphragm 54 in a direction to cause the valve head 44 to close the aperture. In this case, the fluid chamber 50 communicates with the intake passageway 16 through a passage 55 which opens adjacent the edge of the throttle valve 22 through a hole H which is located just upstream of the uppermost portion of the peripheral edge of the throttle valve 22 at its fully closed position. The passage 55 may open to the intake passageway 16 downstream of the throttle valve 22.

A pressure regulating valve assembly 56 is provided to control the vacuum for operating the EGR control valve 42. The valve assembly 56 comprises a housing 58 having therein four chambers 60, 62, 64 and 66, and three flexible diaphragms 68, 70 and 72. The diaphragm 68 separates the chambers 60 and 62 from each other. The diaphragm 70 separates the chambers 62 and 64 from each other. The diaphragm 72 separates the chambers 64 and 66 from each other. The chamber 60 communicates with the atmosphere through a filter medium 74 and with the passage 55 through a passage 76 and an inlet port 78. The chamber 64 communicates through a hole (no numeral) with the atmosphere. The chamber 66 communicates with the chamber 36 of the EGR passageway 30 through a passage 80 which is formed therein with an orifice 82. The diaphragm 70 has a working or pressure sensitive surface area larger than that of each of the diaphragms 68 and 72. The diaphragms 68, 70 and 72 are fixedly connected to each other, for example, by means of a rod 84 so that they are operated as one body. A spring 86 is provided to integrally urge the diaphragms 68, 70 and 72 in a direction opposed to the atmospheric pressure in the chamber 64. An orifice 88 is formed in the passage 55 on the intake passageway side of the junction to which the passage 76 is connected. A regulating valve 90 is located, in the chamber 60, movable relative to the port 78 to control the flow of atmospheric air into the port 78 and is fixedly secured to the diaphragm 68.

The reference numeral 92 denotes a three-way solenoid valve consisting of a casing 94 which defines therein a vacuum chamber 96 and is formed with three ports $P_1$, $P_2$ and $P_3$. As shown, the port $P_1$ is communicated with the chamber 62 of the regulating valve assembly 56 through a passage 98 which is formed therein with an orifice 100. The port $P_2$ is communicated through a passage 102 with a venturi 104 formed in the intake passageway 16 between the airflow meter 24 and the throttle valve 22. The port $P_3$ is communicated through a passage 106 with the intake passageway 16 between the airflow meter 24 and the venturi 104. In this case, a passage 108 is connected to the passage 106 and formed therein with an orifice 110 to induct atmospheric air therethrough into the passage 106.

The three-way solenoid valve 92 has in its vacuum chamber 96 a movable valve member 112 which is normally biased by a spring (no numeral) to the port $P_3$ so as to close the port $P_3$. This valve member 112 is arranged to move to the left in the drawing so as to close the port $P_2$ and open the port $P_3$ when a solenoid coil 114 is energized. The solenoid coil 114 is electrically connected to at least one of a vehicle speed switch 116 incorporated with a speedometer 118 and a gear position switch 120 incorporated with a shift lever 122 of a gearbox (not shown) of the engine. In this case, the vehicle speed switch 116 is arranged to energize the solenoid coil 114 of the three-way solenoid valve 92 when the vehicle crusing speed reaches to a predetermined level of 40 Km/h or more. The gear position switch 120 is arranged to energize the solenoid coil 114 when the gear position in the gearbox is in a range including "top (direct drive)" and "overdrive". It will be understood that the above-mentioned vehicle driving conditions are encountered when the motor-vehicle cruises in a suburban area and accordingly referred to as suburban area driving condition. It is to be noted that, under such vehicle driving conditions, decrease of EGR rate is required to improve the driveability of the vehicle and fuel consumption or fuel economy of the vehicle since a relative stable combustion in the engine is accomplished decreasing NOx generation in the engine under such vehicle driving conditions.

The operation of the thus arranged EGR control system 10 will be discussed hereinafter.

Under urban area driving condition where the vehicle speed is below 40 Km/h and/or the gear position in the gearbox is in "first", "second" or "third", the solenoid coil 114 of the three-way solenoid valve 92 is deenergized so that the port $P_2$ is opened and the port $P_3$ is closed. This provides communication between the passage 102 and the passage 98 and consequently the chamber 62 of the regulating valve assembly 56 is supplied with venturi vacuum. In this state, when the venturi vacuum increases, the diaphragms 68, 70 and 72 are integrally moved so that the valve 90 reduces the degree of opening of the port 78 to reduce the flow of atmospheric air admitted into the passage 76 and therefore the degree of dilution of the suction vacuum conducted into the chamber 50 of the EGR control valve 42 is reduced. As a result, the degree of opening of the EGR control valve 42 is increased to increase the amount of exhaust gases recirculated into the combustion chamber 12 of the engine. This reduces the pressure $P_e$ in the chamber 36 and therefore in the chamber 66 of the valve assembly 56. The decrease in the pressure (vacuum) $P_e$ moves the diaphragms 68, 70 and 72 integrally to increase the degree of opening of the regulating valve 90 to the port 78 to increase the flow of atmospheric air admitted into the passage 76. As a result, the dilution of the suction vacuum by the atmospheric air is increased to reduce the degree of opening of the EGR control valve 42 to increase the pressure $P_e$ in the chamber 36.

On the contrary, when the venturi vacuum is decreased, the degree of dilution of the suction vacuum conducted into the chamber 50 of the EGR control valve is increased and accordingly the degree of opening of the EGR control valve 42 is decreased to decrease the amount of exhaust gases recirculated into the combustion chamber 14 of the engine. This increases the pressure $P_e$ to increase the pressure in the chamber 66 of the valve assembly 56. As a result, the dilution of the suction vacuum by the atmospheric air is decreased to increase the degree of the opening of the EGR control valve 42 to reduce the pressure $P_e$ in the chamber 36. By the repetition of such operations or such feedback controls, the pressure $P_e$ and the degree of opening of the EGR control valve 42 are converged respectively to values in which the pressure $P_e$ is balanced with the venturi vacuum to increase and reduce the recirculated exhaust gas flow accurately in accordance with the increases and decreases in the venturi vacuum.

With the above-mentioned feedback controls, even if the intake vacuum applied to the diaphragm 54 of the EGR control valve 42 varies with the variation of engine load, the amount of the recirculated exhaust gas is maintained constant as far as the same magnitude of the vacuum signal generated at the venturi 104 is supplied to the chamber 62 of the regulating valve assembly 56. Additionally, the pressure $P_e$ is not affected by the intake vacuum at the downstream portion 40 of the EGR passageway 30, even if the intake vacuum in the downstream portion 40 varies.

Furthermore, when the pressure $P_e$ in the chamber 36 is varied regardless of the venturi vacuum by variations in the suction vacuum, the EGR control valve 42 is operated to cancel the variations in the pressure $P_e$ by the pressure regulating valve assembly 56. In this instance, when the pressure $P_e$ is a negative pressure and is increased, the diaphragms 68, 70 and 72 are integrally moved to increase the degree of opening of the regulator valve 90 to the port 78. As a result, the degree of opening of the EGR control valve 42 is reduced similarly as mentioned above to reduce the influence of the suction vacuum on the pressure $P_e$ to restore same to an initial value to prevent the recirculated exhaust gas flow from being varied irrespective of the venturi vacuum.

It will be understood that the pressure $P_e$ is controlled to a predetermined level and therefore the recirculated exhaust gas flow is varied only as a function of the venturi vacuum generated at the venturi of the intake passageway.

Figure 2:
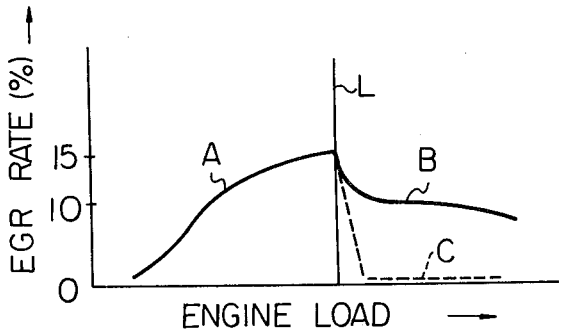
FIG. 2 is a graph showing an example of comparison between two kinds of EGR control manners one of which is according to the EGR control system of FIG. 1.

It will be appreciated from the foregoing discussion, that a suitable control of EGR rate is accomplished under the urban area cuising condition where the engine load is frequently varied causing deterioration of combustion in the engine and accordingly NOx emission level is considerably high. In this connection, the EGR characteristic with such an EGR rate control manner is exemplified by a curve A in FIG. 2. In FIG. 2, a line L indicates a vehicle driving condition where the vehicle cruises at 40 Km/h in "top" gear position in the gearbox.

Under the suburban area cruising condition where the vehicle speed exceeds 40 Km/h and/or the gear position in the gearbox is in the "top" or "overdrive", the solenoid coil 114 of the three-way solenoid valve 92 is energized by the vehicle speed switch 116 and/or the gear position switch 120 to urge the valve member 112 to the left in the drawing. As a result, the port $P_2$ is closed and the port $P_3$ is opened to establish communication between the passage 106 and the passage 98. Then, the chamber 62 of the regulating valve assembly 56 is supplied with a relatively low vacuum which is supplied from the intake passageway 16 between the airflow meter 24 and the venturi 104. In this case, this relatively low vacuum is further diluted with the atmospheric pressure introduced through the orifice 110 which functions to control the degree of the dilution of the vacuum in the passage 106 with the atmospheric pressure. In this connection, the vacuum in the intake passageway 16 between the airflow meter 24 and the venturi 104 is slightly lower than the atmospheric pressure, for example, 60 mmHg at a vehicle speed of 40 Km/h. Of course, the value of this vacuum varies with flow rate of intake air passing through the intake passageway 16.

Consequently, a relatively large degree of the opening of the port 78 is kept causing a relatively large amount of atmospheric air to bleed into the passage 76. This dilutes the vacuum introduced into the chamber 50 of the EGR control valve 42 thereby to cause the valve head 44 to slightly move upward in the drawing. Accordingly, some degree of EGR rate is maintained as the characteristic exemplified by a curve B in FIG. 2 even under the suburban area driving condition of the motor vehicle.

It is to be noted that the above-mentioned EGR control system can give the following significant advantages: Even when the gear position in the gearbox is changed at for a relatively high vehicle speed, for example, the gear change is carried out into "top" at a vehicle speed of 40 Km/h, a large amount decrease in EGR rate does not occur and accordingly stable engine operation is maintained without causing degradation of the driveability of the motor-vehicle. Moreover, under the suburban area driving condition, a considerable EGR rate is maintained as shown in FIG. 2 thereby to attain a necessary degree of NOx generation suppressing effect.

It is to be noted that the characteristic indicated by the curve B in FIG. 2 can be varied by selecting the effective opening size of the orifice 110 formed in the passage 108 to control the degree of dilution of the vacuum in the passage 106 with the atmospheric air bled through the orifice 110. Accordingly, the characteristic indicated by the curve B in FIG. 2 can be varied to some extent.

While the passage 106 connected to the port $P_3$ of the three-way solenoid valve 92 has been shown and described to be supplied with the other passage 108 for bleeding air into the passage 106 therethrough, the passage 106 may not be supplied with the other passage for bleeding air therethrough to directly communicate the port $P_3$ with the intake passageway 16 between the airflow meter 24 and the venturi 104.

Figure 3:
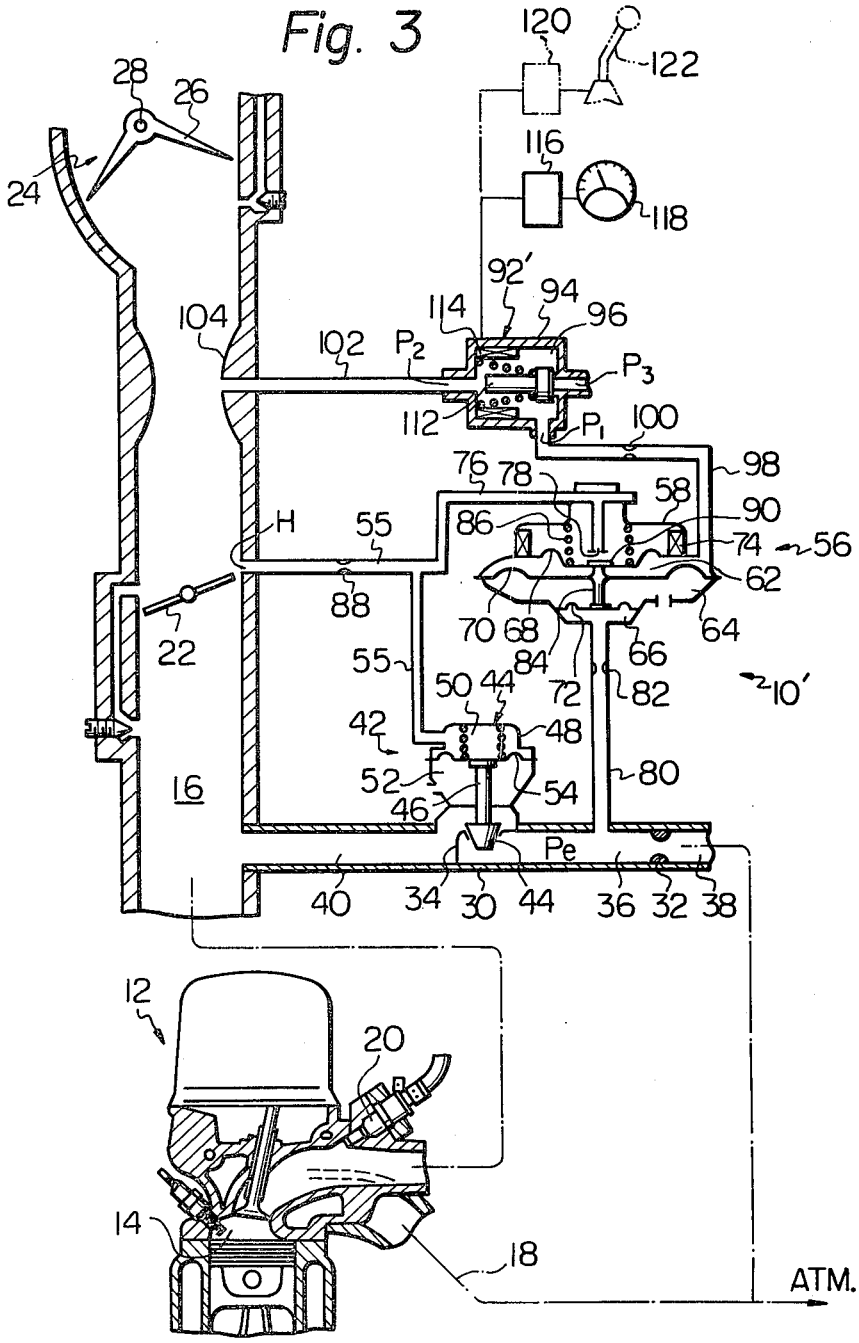
FIG. 3 is a schematic illustration similar to FIG. 1, but shows an example of an EGR control system which is not within the scope of the present invention, on which the present invention has been established.

Referring to FIG. 3, an example of an EGR control system 10' is shown in combination with an automotive internal combustion engine 12 equipped with an electronically controlled fuel injection system. This EGR control system 10' is substantially the same as that disclosed in the pending application of Syunichi Aoyama, U.S. Pat. Ser. No. 851,190, filed on Nov. 14, 1977 and entitled "Improved Exhaust Gas Recirculation Control System". The present application has disclosed an improvement in the EGR control system disclosed in the pending application.

The EGR control system in FIG. 3 has many similar parts and elements to that shown in FIG. 1 and, as such, like reference numerals and characters are assigned to corresponding parts and elements for the purpose of simplicity of description. The EGR control system in FIG. 3 is essentially differs from that of the present invention shown in FIG. 1 in the point where the port $P_3$ of the three-way solenoid valve 92' is communicated only with the atmosphere without communicating with the intake passageway 16 between the airflow meter 24 and the venturi 104.

With the arrangement of the EGR control system 10' in FIG. 3, under the urban area driving condition of the motor vehicle, the valve member 114 of the three-way solenoid valve 92' is urged to close the port $P_3$ and open the port $P_2$. As a result, the EGR control system 10' operates and functions in the same manner as the system 56 in FIG. 1.

However, under the suburban area driving condition where the vehicle speed exceeds 40 Km/h and/or the gear position in the gearbox is in "top" or "overdrive", the solenoid coil 114 of the solenoid valve 92' is energized to move the valve member 112 to the left in the drawing so that the port $P_2$ is closed and the port $P_3$ is opened. Then, the chamber 62 of the regulating valve assembly 56 is supplied with the atmospheric air to kept the port 78 fully opened. A large amount of the atmospheric air bleeds into the passage 76 and consequently the value of vacuum in the chamber 50 of the EGR control valve 42 extremely lowered and closes to the atmospheric pressure. As a result, the valve head 44 almost seats on the valve seat formed in the partition wall 34 thereby to almost close the EGR passageway 30 so as to block the exhaust gas recirculation to the intake passageway 16. Hence, the EGR rate closes to 0% as seen from the characteristic exemplified by a line C in FIG. 2.

It will be appreciated that, with the EGR control characteristic by the system shown in FIG. 3, the instant the vehicle speed exceeds 40 Km/h and/or the gear position in the gearbox is changed to "top" and "overdrive", a great degree of decrease in EGR rate abruptly occurs and accordingly the combustion in the engine is abruptly changed, which causes degradation in driveability of the motor vehicle. If a considerably small orifice is formed in the port $P_3$ to restrict airflow through the port $P_3$, the EGR rate may be prevented from a abrupt change of lowing, but it may be unavoidable to prevent the EGR rate from being lowered near 0% under the suburban area driving condition, as indicated by the line C in FIG. 2. In this connection, the small orifice is liable to be clogged with foreign materials and accordingly too small orifice is undesirable. It will be noted that almost no EGR is not desirable from a point of view of exhaust gas emission control, even under the suburban area driving condition.

It will be appreciated from the description with reference to FIG. 1, that the above-mentioned problems encountered in the EGR control system of the type shown in FIG. 3 can be effectively solved by the EGR control system according to the present invention. Therefore, the present invention provides an significant improvement in the EGR control system of the type shown in FIG. 3.

What is claimed is:

1. An exhaust gas recirculation (EGR) control system in combination with motor-vehicle internal combustion engine equipped with an electronically controlled fuel injection system, including a combustion chamber, an intake passageway providing communication between the atmosphere and the combustion chamber, a venturi formed in the intake passageway, a throttle valve rotatably disposed in the intake passageway downstream of the venturi, an airflow meter disposed in the intake passageway upstream of the venturi for providing an information of airflow to the fuel injection system, and an exhaust gas passageway providing communication between the combustion chamber and the atmosphere, said EGR control system comprising:

EGR passageway means providing communication between the exhaust gas passageway and the intake passageway to recirculate exhaust gas back to the combustion chamber;

a diaphragm actuated EGR control valve operatively disposed in said EGR passageway means to divide said EGR passageway means into an upstream portion connecting to the exhaust gas passageway and a downstream portion connecting to the intake passageway, the diaphragm of said EGR control valve defining a first chamber which communicates through first passage means with the intake passageway to provide the first chamber with intake vacuum in the intake passageway, said EGR control valve being operative in accordance with the intake vacuum, to control the pressure of the exhaust gas in the upstream portion of said EGR passageway means so as to control the flow of the recirculated exhaust gas;

regulating means for regulating the intake vacuum to be provided to the first chamber of said EGR control valve in accordance with the exhaust gas pressure in the upstream portion and in accordance with the vacuum in the venturi, said regulating means including second passage means connecting to said first passage means and having an inlet port communicating with the atmosphere, a pressure regulating valve movable relative to said inlet port of said second passage means for controlling the flow of atmospheric air bled through said inlet port into said second passage means, first and second flexible diaphragms defining a second chamber and a third chamber communicating with the upstream portion of said EGR passageway means, said first and second flexible diaphragms operatively connect to each other and being operatively connected to said pressure regulating valve so as to operate said pressure regulating valve in response to the pressures in said second selective means for selectively provide the second chamber of said regulating means with the venturi vacuum generated in the venturi and with at least a vacuum generated in the intake passageway between the airflow meter and the venturi, in accordance with driving conditions of the motor-vehicle.

2. An EGR system as claimed in claim 1, in which said selective means includes selective valve means operatively connected to the second chamber of said regulating means and taking a first state to provide communication between the second chamber and the venturi and a second state to provide communication between the second chamber and the at least intake passageway between the airflow meter and the venturi, and putting means for putting said valve means into the first state under urban area driving condition of the vehicle and into the second state under suburban area driving condition of the vehicle.

3. An EGR control system as claimed in claim 2, in which said putting means includes at least one of a vehicle speed switch operatively connected to said selective valve means to put said selective valve means into the second state when the vehicle speed is a predetermined value or more, and an gear position switch operatively connected to said selective valve means to put said selective valve means into the second state when gear in the gearbox of the engine is in a predetermined position.

4. An EGR control system as claimed in claim 3, in which said selective valve means is a three-way solenoid valve having a first port means communicated through third passage means with the second chamber of said regulating means, a second port means communicated through fourth passage means with the venturi, a third port means communicated through fifth passage means with the intake passageway between the airflow meter and the venturi, and a movable valve member which takes a first position to open the second port means and close the third port means so as to establish communication between the third and fourth passage means when the solenoid coil of said three-way solenoid valve is energized, and a second position to close the second port means and open the third port means so as to establish communication between the third passage means and the fifth passage means.

5. An EGR control system as claimed in claim 4, in which said fifth passage means having a sixth passage means provided with an orifice therein to bleed air into the fifth passage means.

6. An EGR control system as claimed in claim 4, in which said vehicle speed switch is electrically connected to the solenoid coil of said three-way solenoid valve and arranged to energize the solenoid coil when the vehicle speed is the predetermined value or more, and said gear position switch is electrically connected to the solenoid coil and arranged to energize the solenoid coil when the gear in the gearbox is in the predetermined position.

7. An EGR control system as claimed in claim 3, in which the predetermined value of vehicle speed is 40 Km/h, and the predetermined position in the gearbox is in a range including "top" and "overdrive".

8. An EGR control system as claimed in claim 1, in which said EGR passageway means has in its upstream portion an orifice which defining a chamber communicating with the third chamber of said regulating means.

9. An EGR control means as claimed in claim 1, in which the airflow meter includes a measuring plate which is operatively located in the intake passageway and angularly movable by the stream of the intake air passing through the intake passageway.

* * * * *